US011161017B1

(12) United States Patent
Varan

(10) Patent No.: US 11,161,017 B1
(45) Date of Patent: Nov. 2, 2021

(54) RACKET WITH DISCONTINUOUS FRAME

(71) Applicant: Cyrus O. Varan, Red Beach (NZ)

(72) Inventor: Cyrus O. Varan, Red Beach (NZ)

( * ) Notice: Subject to any disclaimer, the term of this patent is extended or adjusted under 35 U.S.C. 154(b) by 28 days.

(21) Appl. No.: 16/844,288

(22) Filed: Apr. 9, 2020

(51) Int. Cl.
*A63B 49/02* (2015.01)
*A63B 49/028* (2015.01)
*A63B 102/02* (2015.01)

(52) U.S. Cl.
CPC ..... *A63B 49/028* (2015.10); *A63B 2102/02* (2015.10)

(58) Field of Classification Search
CPC ..... A63B 49/00; A63B 49/02; A63B 49/028; A63B 49/03; A63B 49/08
See application file for complete search history.

(56) References Cited

U.S. PATENT DOCUMENTS 1,470,878 A * 10/1923 Robinson ..... A63B 49/12 473/534
3,834,699 A * 9/1974 Pass ..... A63B 51/00 473/543
3,917,267 A * 11/1975 McGrath ..... A63B 49/02 473/545
4,153,249 A * 5/1979 Plagenhoef ..... A63B 60/12 473/537
4,184,679 A * 1/1980 Mishel ..... A63B 51/08 473/531
4,595,201 A * 6/1986 Fischer ..... A63B 49/022 473/534
4,828,260 A * 5/1989 Todd ..... A63B 49/022 473/521
5,133,552 A * 7/1992 Feeney ..... A63B 60/54 473/537
5,236,197 A * 8/1993 Chen ..... A63B 49/02 473/519
5,282,617 A * 2/1994 Hong ..... A63B 49/02 473/546
5,350,173 A * 9/1994 DiCerbo ..... A63B 60/54 473/521
5,605,327 A * 2/1997 McCutchen ..... A63B 60/54 473/523
9,132,322 B1 * 9/2015 Coley ..... A63B 51/08
(Continued)

FOREIGN PATENT DOCUMENTS

DE 102007056831 A1 * 5/2009 ..... A63B 60/00
EP 0221688 A2 * 5/1987 ..... A63B 60/54
(Continued)

*Primary Examiner* — Raleigh W Chiu
(74) *Attorney, Agent, or Firm* — Woods Oviatt Gilman LLP; Ronald J. Kisicki, Esq.; Dennis B. Danella, Esq.

(57) ABSTRACT

A racket includes a handle to be gripped by a user and a head. The head has a frame defining an open interior having a perimeter. The frame is coupled to a first end of the handle at a first point along the perimeter. The frame is discontinuous and includes a first terminal end point and a second terminal end point defining a gap along the perimeter at a second point which is different than the first point. A biasing member is coupled to the first and second terminal end points so as to span the gap. A plurality of strings traverses the open interior, with a first set of spaced strings being arranged angularly offset from a second set of spaced strings to form a grid-like string pattern.

20 Claims, 1 Drawing Sheet

(56) References Cited

U.S. PATENT DOCUMENTS

| | | | | |
|---|---|---|---|---|
| 2001/0031676 | A1* | 10/2001 | Luskin | A63B 51/08 473/524 |
| 2002/0098924 | A1* | 7/2002 | Houser | A63B 60/54 473/524 |
| 2002/0128093 | A1* | 9/2002 | Whayne | A63B 49/02 473/520 |
| 2006/0211526 | A1* | 9/2006 | Hauptman | A63B 51/00 473/524 |
| 2016/0310804 | A1* | 10/2016 | Adamczak | A63B 49/08 |

FOREIGN PATENT DOCUMENTS

| | | | | |
|---|---|---|---|---|
| FR | 2666994 | A1 * | 3/1992 | A63B 60/06 |
| FR | 2751235 | A1 * | 1/1998 | A63B 49/08 |
| WO | WO-8303358 | A1 * | 10/1983 | A63B 51/08 |
| WO | WO-03099387 | A2 * | 12/2003 | A63B 49/022 |

* cited by examiner

RACKET WITH DISCONTINUOUS FRAME

TECHNICAL FIELD

The present invention relates to a sports racket, and more particularly to a sports racket configured to provide increased driving force to an object struck by the racket; and still more particularly to a stringed sports racket having a discontinuous frame with a biasing member mounted across the gap formed within the discontinuous frame.

BACKGROUND OF THE INVENTION

Sports racket designs, such as a typical tennis racket, have remained relatively unchanged. Traditional rackets consist of a frame having a head equipped with strings and a handle attached to the head. The stretching and contracting of the strings when a ball is struck provides some of the rebounding power imparted to the ball. Racket designers have unsuccessfully attempted to add racket power by spring loading the connection of the handle to the head. These efforts have been unsuccessful, in part, due to the need of a heavy spring which results in a heavy racket.

Further, the repeated stretching and contracting of racket strings in a traditional racket during aggressive play often leads to string breakage. During tournament play, a broken string may result in a loss of points or a loss of the match itself.

It is a principal object of the present invention to address these, as well as other, needs by providing a sports racket having a frame with a discontinuous head and a biasing member mounted across the gap formed within the discontinuous head so as to provide increased driving force to an object struck by the racket and to diminish string breakage.

SUMMARY OF THE INVENTION

Briefly described, a racket includes a handle to be gripped by a user and a head. The head has a frame defining an open interior having a perimeter. The frame is coupled to a first end of the handle at a first point along the perimeter. The frame is discontinuous and includes respective ends generally defined as a first terminal end point and a second terminal end point defining a gap along the perimeter at a second point which is different than the first point. A biasing member is coupled to the first and second terminal end points so as to span the gap. A plurality of strings traverses the open interior, with a first set of spaced strings being arranged angularly offset from a second set of spaced strings to form a grid-like string pattern. The first set of spaced strings may be interwoven with the second set of spaced strings and each of the first and second sets of spaced strings may be oriented at about a 45 degree angle with respect to a longitudinal axis of the handle.

In a further aspect of the present invention, the first terminal end point may include a first casing having a first internal opening width and the second terminal end point may include a second casing having a second internal opening width. At least a portion of the first casing may then be slidably received within the second casing with the biasing member dimensioned to be received within the first casing.

In another aspect of the present invention, the second point (i.e., the biasing member) is opposite the first point (i.e., the handle) on the parameter. The distal end end of the handle may define a rounded cross-section and the biasing member may be a helical compression spring or an elastic tubular ring.

Numerous applications, some of which are exemplarily described below, may be implemented using the present invention.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
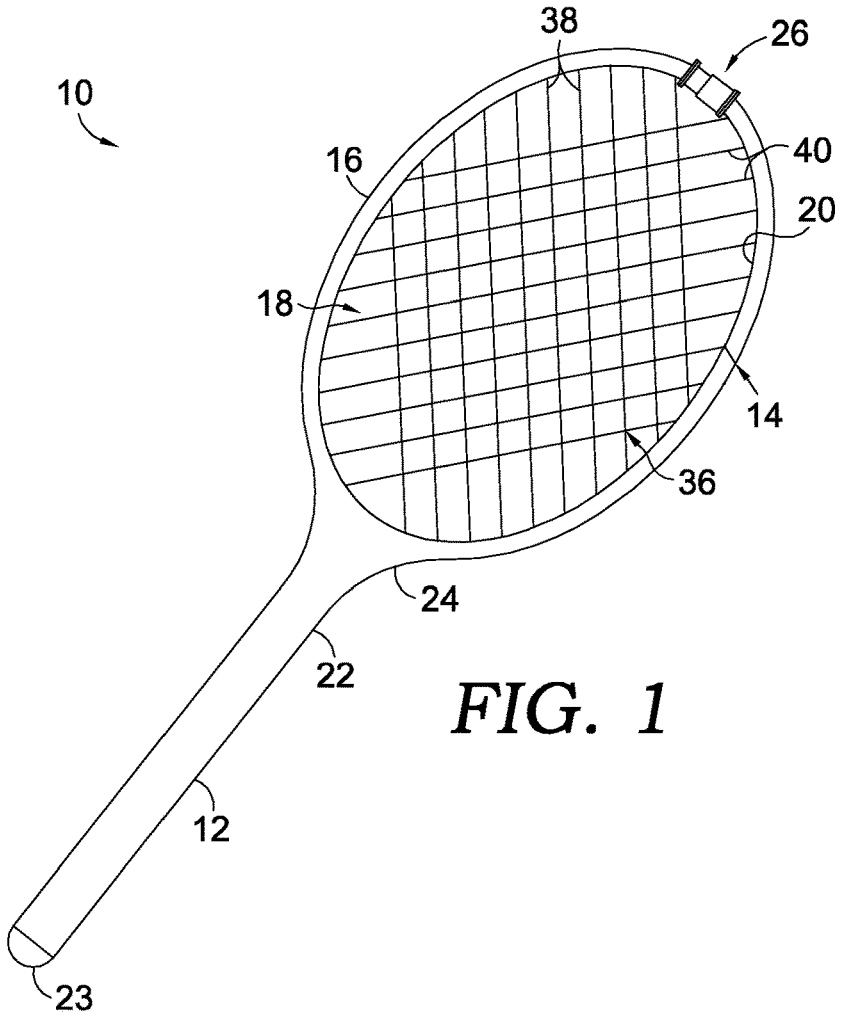
FIG. 1 is a front plan view of a racket in accordance with the present invention.
Figure 2:
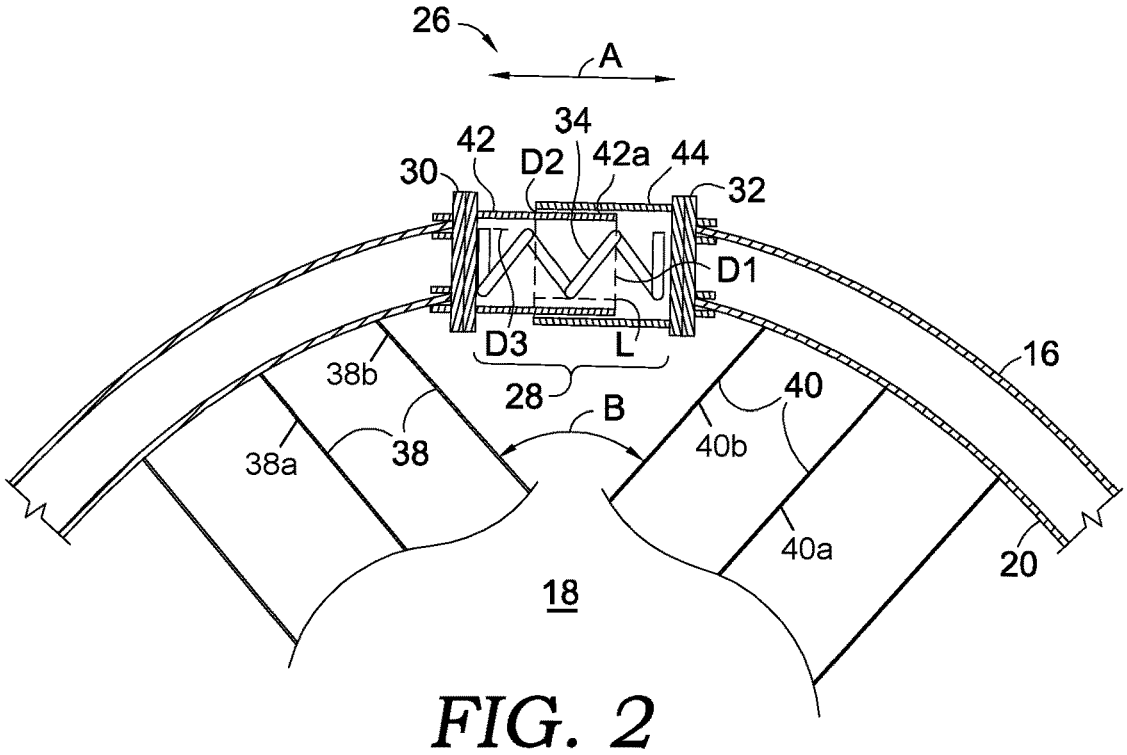
FIG. 2 is an expanded view of the discontinuous portion of the head of the racket shown in FIG. 1.

Referring now to FIGS. 1 and 2, an embodiment of a racket 10 in accordance with an aspect of the present invention generally comprises a handle 12 and head 14. Head 14 includes a frame 16 which defines an open interior 18 having an inner perimeter 20. Open interior 18 may be circular or oval shaped as shown and perimeter 20 may be a circumference of the circular or oval shaped open interior. Frame 16 is coupled to handle 12 at handle first end 22 via frame neck portion 24. Handle 12 and head 14 may be formed as a single piece unit or may be distinct production units which are then later joined together to form a completed racket 10. Distal end 23 of handle 22 may be rounded, e.g., defines a rounded cross-section so as to promote ease of grip in a user's hand.

As shown most clearly in FIG. 2, frame 16 includes a discontinuous region 26 having a gap 28 defined between respective ends of frame 16 shown as, for example, first terminal end point 30 and second terminal end point 32 of frame 16. In accordance with an aspect of the present invention, discontinuous region 26 and gap 28 may be located opposite first end 22 of handle 12 along perimeter 20. In accordance with another aspect, frame 16 may further include a biasing member 34 positioned within gap 28 and between first and second terminal end points 30, 32. Biasing member 34 is configured to bias first terminus 30 and second terminus 32 outwardly (as indicated generally by arrow A) so as to increase the length of gap 28. Biasing member 34 may be a resilient member, such as a compression spring or an elastic tubular ring.

With continued reference to FIG. 2, head 14 may also include a plurality of strings 36 traversing open interior 18. A first set of spaced strings 38 may be arranged angularly offset (angle B) from a second set of spaced strings 40 so as to form a grid-like string pattern as seen in FIG. 1. First string **38*a* of string set 38 need not be oriented parallel with second string 38*b* of string set 38. Likewise, first string 40*a* of string set 40 need not be oriented parallel with second string 40*b* of string set 40. Also, the angular offset between the string sets 38, 40 need not be 90 degrees. Thus, the resulting grid-like pattern of the crossed-sets of strings may be in the form of a square, if angle B is 90 degrees, or diamond shaped if angle B is not 90 degrees. Further, the first set of strings 38 and the second set of strings 40 may both be oriented at about a 45 degree angle with respect to a longitudinal axis L of handle 12**.

During use, racket 10 is initially in an unloaded condition wherein biasing member 34 is at rest and non-biased, with strings 36 taut within the plane created by frame 16. Thereupon, contact with an object, such as a tennis ball, against strings 36 exerts a displacement force against strings 36 which displaces strings 36 outwardly of the plane of frame 16, thereby stretching strings 36 with string potential energy (PE). Displacement of strings 36 may then cause frame 16 to flex such that first terminal end point 30 moves toward second terminal end point 32. Such movement compresses biasing member 34 whereby biasing member 34 becomes loaded with biasing member PE. Once the displacement force equals the sum of the string PE and biasing member PE, the object momentarily comes to a standstill before being subjected to a rebound force. The rebound force propels the object away from racket 10 due to release of the stored string PE and biasing member PE.

In accordance with an aspect of the present invention, the rebound force exerted by racket 10 upon the object is greater than the rebound force exerted on the object by a prior art racket. Without being tied exclusively to any theory, it is believed that the discontinuity of frame 16, along with biasing member 34, allows racket head 14 to temporarily deform in the region of gap 28 thereby allowing biasing member 34 to compress and store a predictable amount of biasing member PE therein, which can then be controllably released and redirected into the rebound force.

To accommodate the movement of first and second terminal end points 30, 32 of frame 16, described above, first terminal end point 30 may include a first casing 42 having a first internal opening width D1 while second terminal end point 32 may include a second casing 44 having a second internal opening width D2. The cross-sections of casings 42 and 44 may be of any shape, including circular, square, rectangular or oval. D1 and D2 are dimensioned such that at least a portion 42*a* of first casing 42 is slidably received within second casing 44. Additionally, biasing member 34 is dimensioned to have a third width D3 slightly smaller than D1 whereby biasing member 34 may be received within first casing 42. Portion 42*a* has a length L which is selected to be greater than the allowable movement of first terminal end point 30 with respect to second terminal end point 32 such that first casing 42 and biasing member 34 cannot exit second casing 44 upon exertion of the displacement force on strings 36, as discussed above.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A racket comprising:

a) a handle configured to be gripped by a user; and b) a head including:

i) a frame defining an open interior having a perimeter, wherein said frame is coupled to a first end of the handle at a first point along said perimeter, and wherein said frame is discontinuous and includes a first terminal end point and a second terminal end point defining a gap along said perimeter at a second point which is different than said first point; and ii) a resilient biasing member coupled to said first and second terminal end points so as to span the gap.

2. The racket in accordance with claim 1 wherein said second point is opposite said first point on said perimeter.

3. The racket in accordance with claim 1 wherein said racket further comprises a plurality of strings traversing said open interior, wherein a first set of spaced strings are arranged angularly offset from a second set of spaced strings to form a grid-like string pattern.

4. The racket in accordance with claim 3 wherein said first set of spaced strings is interwoven with said second set of spaced strings.

5. The racket in accordance with claim 3 wherein said first set of spaced strings and said second set of spaced strings are oriented at about a 45 degree angle with respect to a longitudinal axis of said handle.

6. The racket in accordance with claim 3 wherein said first set of spaced strings are angularly offset from said second set of spaced strings at about 90 degrees.

7. The racket in accordance with claim 3 wherein said first set of spaced strings includes a first string and a second string, wherein said first and second strings of said first set of spaced strings are parallel spaced.

8. The racket in accordance with claim 7 wherein said second set of spaced strings includes a first string and a second string, wherein said first and second strings of said second set of spaced strings are parallel spaced.

9. The racket in accordance with claim 1 wherein a distal end of said handle defines a rounded cross-section.

10. The racket in accordance with claim 1 wherein said biasing member comprises one of a helical compression spring or an elastic tubular ring.

11. The racket in accordance with claim 1 wherein said first terminal end point includes a first casing having a first width and said second terminal end point includes a second casing having a second width, wherein at least a portion of said first casing is slidably received within said second casing and wherein said biasing member is dimensioned to be received within said first casing.

12. The racket in accordance with claim 11 wherein a cross-section of at least one of said first casing or said second casing is circular.

13. A racket comprising:

a) a handle configured to be gripped by a user; and b) a head including:

i) a frame defining an open interior having a perimeter, wherein said frame is coupled to a first end of the handle at a first point along said perimeter, and wherein said frame is discontinuous and includes a first terminal end point and a second terminal end point defining a gap along said perimeter at a second point which is different than said first point; and ii) a biasing member coupled to said first and second terminal end points so as to span the gap, wherein said first terminal end point includes a first casing having a first width and said second terminal end point includes a second casing having a second width, wherein at least a portion of said first casing is slidably received within said second casing and wherein said biasing member is dimensioned to be received within said first casing.

14. The racket in accordance with claim 13 wherein a cross-section of at least one of said first casing or said second casing is circular.

15. A racket comprising:

a) a handle configured to be gripped by a user; and b) a head including:

i) a frame defining an open interior having a perimeter, wherein said frame is coupled to a first end of the handle at a first point along said perimeter, and wherein said frame is discontinuous and includes only one gap at a second point along said perimeter, wherein said only one gap includes a first terminal end point and a second terminal end point and wherein said second point is different than said first point, wherein said first terminal end point includes a first casing having a first width and said second terminal end point includes a second casing having a second width, wherein at least a portion of said first casing is slidably received within said second casing;

ii) a biasing member coupled to said first and second terminal end points so as to span said only one gap, wherein said biasing member is dimensioned to be received within said first casing.

16. The racket in accordance with claim 15 wherein said second point is opposite said first point on said perimeter.

17. The racket in accordance with claim 15 wherein said racket further comprises a plurality of strings traversing said open interior, wherein a first set of spaced strings are arranged angularly offset from a second set of spaced strings to form a grid-like string pattern.

18. The racket in accordance with claim 17 wherein said first set of spaced strings is interwoven with said second set of spaced strings.

19. The racket in accordance with claim 15 wherein a cross-section of at least one of said first casing or said second casing is circular.

20. A racket comprising:

a) a handle configured to be gripped by a user; and b) a head including:

i) a frame defining an open interior having a perimeter, wherein said frame is coupled to a first end of the handle at a first point along said perimeter, and wherein said frame is discontinuous and includes only one gap at a second point along said perimeter, wherein said only one gap includes a first terminal end point and a second terminal end point and wherein said second point is different than said first point; and ii) a biasing member coupled to said first and second terminal end points so as to span said only one gap, wherein said biasing member comprises one of a helical compression spring or an elastic tubular ring.

* * * * *